US008865640B2

(12) United States Patent
Subramanyam et al.

(10) Patent No.: US 8,865,640 B2
(45) Date of Patent: Oct. 21, 2014

(54) FATTY ACID CHAIN SATURATION IN ALKANOL AMINE BASED ESTERQUAT

(75) Inventors: Ravi Subramanyam, Mumbai (IN); Charles J. Schramm, Jr., Neshanic, NJ (US); Aarti Rege, East Windsor, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 13/696,925

(22) PCT Filed: May 28, 2010

(86) PCT No.: PCT/US2010/036542

§ 371 (c)(1), (2), (4) Date: Nov. 8, 2012

(87) PCT Pub. No.: WO2011/149475

PCT Pub. Date: Dec. 1, 2011

(65) Prior Publication Data

US 2013/0059767 A1 Mar. 7, 2013

(51) Int. Cl.

| | |
|---|---|
| ***C11D 1/62*** | (2006.01) |
| ***C11D 3/00*** | (2006.01) |
| ***C11D 3/50*** | (2006.01) |

(52) U.S. Cl.

CPC ..... *C11D 1/62* (2013.01); *C11D 3/0015* (2013.01); *C11D 3/50* (2013.01)

USPC ..... 510/515

(58) Field of Classification Search

USPC ..... 510/515

See application file for complete search history.

(56) References Cited

U.S. PATENT DOCUMENTS

| | | | |
|---|---|---|---|
| 3,915,867 | A | 10/1975 | Kang et al. |
| 4,137,180 | A | 1/1979 | Naik et al. |
| 4,767,547 | A | 8/1988 | Straathof et al. |
| 4,806,345 | A | 2/1989 | Bhattacharyya |
| 5,476,598 | A | 12/1995 | Schramm |
| 5,501,806 | A | 3/1996 | Farooq et al. |
| 5,545,340 | A | 8/1996 | Wahl et al. |
| 5,545,350 | A | 8/1996 | Baker et al. |
| 5,562,849 | A | 10/1996 | Wahl et al. |
| 5,574,179 | A | 11/1996 | Wahl et al. |
| 5,747,108 | A | 5/1998 | Farooq et al. |
| 5,880,084 | A | 3/1999 | Ewbank |

(Continued)

FOREIGN PATENT DOCUMENTS

| | | |
|---|---|---|
| EP | 1876224 | 1/2008 |
| WO | WO 90/12862 | 11/1990 |

OTHER PUBLICATIONS http://assets.nationalrenderers.org/pocket_information_manual.pdf 2003, no month available.*

(Continued)

*Primary Examiner* — John Hardee

(74) *Attorney, Agent, or Firm* — Michael F. Morgan

(57) ABSTRACT

A composition comprising an esterquat that is a quaternized reaction product of an alkanol amine and a fatty acid having a ratio of fatty acid to alkanol amine of 1.5 to 1.75, wherein 45 to 75% by weight of the fatty acids are saturated. Also, a method of softening a fabric and increasing fragrance delivery comprising treating the fabric with the composition.

6 Claims, 4 Drawing Sheets

(56) References Cited

U.S. PATENT DOCUMENTS

| | | | | |
|---|---|---|---|---|
| 5,916,863 | A | 6/1999 | Iacobucci et al. | |
| 5,919,750 | A | 7/1999 | Iacobucci | |
| 6,004,913 | A | 12/1999 | Iacobucci et al. | |
| 6,037,315 | A | 3/2000 | Franklin et al. | |
| 6,057,285 | A | 5/2000 | Pèscador et al. | |
| 6,323,167 | B1 * | 11/2001 | Franklin et al. | 510/123 |
| 6,559,117 | B1 | 5/2003 | Severns et al. | |
| 6,737,392 | B1 | 5/2004 | Keys et al. | |
| 6,770,608 | B2 | 8/2004 | Franklin et al. | |
| 6,864,223 | B2 | 3/2005 | Smith et al. | |
| 2002/0025915 | A1 * | 2/2002 | Franklin et al. | 510/515 |
| 2003/0139317 | A1 * | 7/2003 | Behler et al. | 510/421 |
| 2005/0250670 | A1 * | 11/2005 | Caswell et al. | 510/522 |
| 2006/0003914 | A1 * | 1/2006 | Frankenbach | 510/515 |
| 2007/0054835 | A1 * | 3/2007 | Corona et al. | 510/515 |
| 2010/0331231 | A1 * | 12/2010 | Bermejo Oses et al. | 510/521 |

OTHER PUBLICATIONS

Pocket Information Manual. A Buyer's Guide to Rendered Products. National Renderer's Association, Inc., 2003. No month available.*

Retrieved from the Internet: URL:http://en.wikipedia.org/wiki/Iodine_value [retrieved on May 25, 2012].

Retrieved from the Internet: URL:http://en.wikipedia.org/w/index.php?title=Tallow&oldid=292642382 (May 27, 2009) [retrieved on May 25, 2012].

International Search Report issued for International Application No. PCT/US2010/036542 mailed Feb. 11, 2011.

Written Opinion of the International Preliminary Examining Authority issued for International Application No. PCT/US2010/036542 mailed Jun. 5, 2012.

* cited by examiner

FATTY ACID CHAIN SATURATION IN ALKANOL AMINE BASED ESTERQUAT

CROSS-REFERENCE TO RELATED APPLICATIONS

This application is a national stage entry under 35 U.S.C. §371 of International Patent Application No. PCT/US2010/036542, filed on May 28, 2010, which is hereby incorporated by reference in its entirety.

BACKGROUND

Esterquat, a quaternary ammonium compound, is a fabric softening molecule. It is typically formed when the reaction product of long chain (C12-C22 or C16-C18) fatty acids and a tertiary amine is esterified in the presence of an acid catalyst and subsequently quaternized to obtain quaternary ammonium salts. The final product is a mixture of mono, di and tri ester components. The quaternary ammonium compound giving particular good performance and stability profiles are obtained from reaction of C12-C22 fatty acids or the hydrogenation products, usually containing some degree of unsaturation, the iodine value range of 20-90.

Saturated alkyl chains deliver greater softening efficacy compared to unsaturated ones. Cationic surfactants, when dispersed in water, form multilayer particles called vesicles that in turn deposit on fabrics. Saturated alkyl chains deliver stronger vesicle structure giving higher softening efficacy as well as fragrance delivery, compared to unsaturated alkyl chains. The increment in saturation level, however, increases the melting point and imposes handling and processing challenges because of the higher melting material. Currently, esterquat products contain 75% soft and 25% hard fatty acids or 100% hard fatty acids.

BRIEF SUMMARY

A composition comprising an esterquat that is a quaternized reaction product of an alkanol amine and a fatty acid having a ratio of fatty acid to alkanol amine of 1.5 to 1.75, wherein 45 to 75% by weight of the fatty acids are saturated.

Also, a method of softening a fabric and increasing fragrance delivery comprising treating the fabric with the composition.

Also, a use of the composition as a fabric softener.

DETAILED DESCRIPTION

Figure 1A:
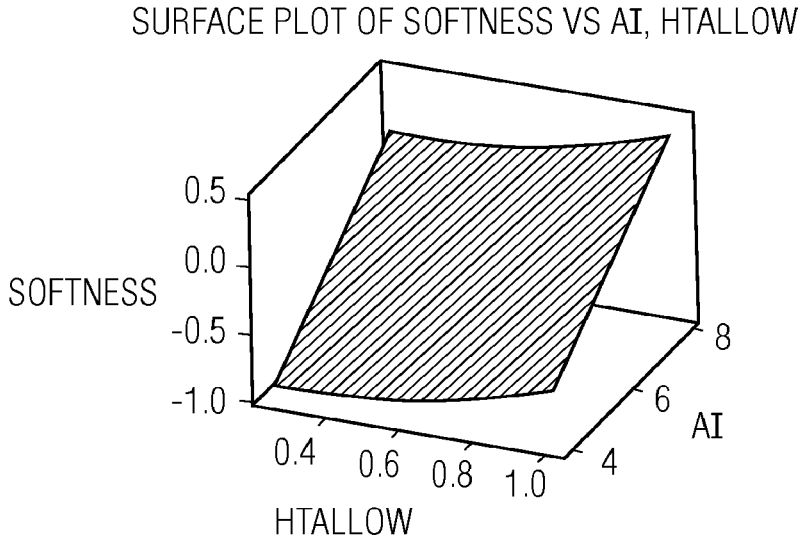
FIG. 1A is a surface plot of softness of different fabric softeners having varying levels of hydrogenated tallow and varying levels of active esterquat levels (AI). Softness is measured on the vertical axis, percentage of hydrogenated tallow is on the horizontal axis, and AI level is on the depth axis.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

AI refers to the active weight of the combined amounts for monoesterquat, diesterquat, and triesterquat.

Delivered AI refers to the mass (in grams) of esterquat used in a laundry load. A load is 3.5 kilograms of fabric in weight. As the size of a load changes, for example using a smaller or larger size load in a washing machine, the delivered AI adjusts proportionally.

The selection of the percentage of saturated fatty acids (hard/soft fatty acid ratio) and the distribution of monoesterquat, diesterquat, and triesterquat (which is controlled by the ratio of fatty acid to methyl ester ratio described below) allows for a selection for a desired balance of fabric softening and fragrance delivery. While fully saturated fatty acids provide better softening capabilities, the full saturation also impacts the ability to fragrance the material because of the increased energy requirements to mix a solid material as compared to a liquid material. There are also increased energy costs to maintain the esterquat in liquid form so that it can be formulated into a fabric softener. For example, going from 25%/75% hard/soft esterquat to a 50/50 hard/soft esterquat requires 2-3° C. higher temperature to maintain the esterquat as a liquid. Going to 100% saturated fatty acid requires an even higher temperature and additional processing measures, such as a nitrogen blanket, to handle and process the material. It has been discovered that desired softness and desired fragrance delivery can be obtained for esterquats that do not contain 100% saturated fatty acids.

The esterquats are represented by the following structure:

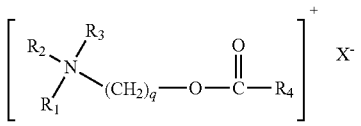

wherein $R_4$ represents an aliphatic hydrocarbon group having from 8 to 22 carbon atoms, $R_2$ and $R_3$ represent $(CH_2)_s$—$R_5$ where $R_5$ represents an alkoxy carbonyl group containing from 8 to 22 carbon atoms, benzyl, phenyl, (C1-C4)-alkyl substituted phenyl, OH or H; R1 represents $(CH_2)$, $R_6$ where $R_6$ represents benzyl, phenyl, (C1-C4)-alkyl substituted phenyl, OH or H; q, s, and t, each independently, represent an integer from 1 to 3; and $X^-$ is a softener compatible anion.

The esterquat is produced by reacting about 1.65 (1.5 to 1.75) moles of fatty acid methyl ester with one mole of alkanol amine followed by quaternization with dimethyl sulfate (further details on this preparation method are disclosed in U.S. Pat. No. 3,915,867). Using this ratio controls the amount of each of monoesterquat, diesterquat, and triesterquat in the composition. In certain embodiments, the alkanol amine comprises triethanolamine. In certain embodiments, it is desirable to increase the amount of diesterquat and minimize the amount of triesterquat to increase the softening capabilities of the composition. By selecting a ratio of about 1.65, the triesterquat can be minimized while increasing the monoesterquat.

Monoesterquat is more soluble in water than triesterquat. Depending on the AI, more or less monoesterquat is desired. At higher AI levels (usually at least 7%), more monoesterquat as compared to triesterquat is desired so that the esterquat is more soluble in the water so that the esterquat can be delivered to fabric during use. At lower AI levels (usually up to 3%), less monoesterquat is desired because during use, it is desired for the esterquat to leave solution and deposit on fabric to effect fabric softening. Depending on the AI, the amount of monoesterquat and triesterquat are adjusted to balance solubility and delivery of the esterquat.

In certain embodiments, the reaction products are 50-65 weight % diesterquat, 20-40 weight % monoester, and 25 weight % or less triester, which are shown below:

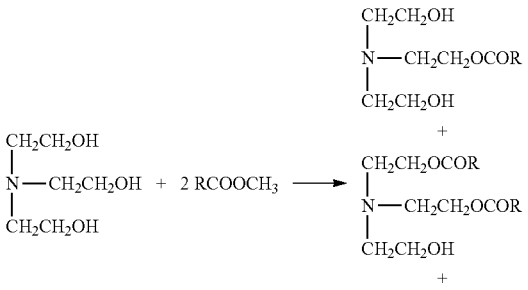

-continued

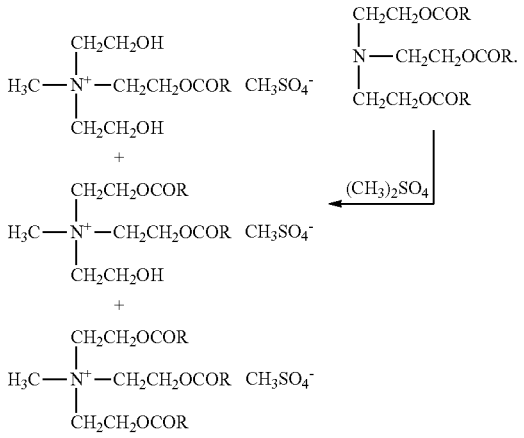

In other embodiments, the amount of diesterquat is 52-60, 53-58, or 53-55 weight %. In other embodiments, the amount of monoesterquat is 30-40 or 35-40 weight %. In other embodiments, the amount of triesterquat is 1-12 or 8-11 weight %.

The percentages, by weight, of mono, di, and tri esterquats, as described above are determined by the quantitative analytical method described in the publication "Characterisation of quaternized triethanolamine esters (esterquats) by HPLC, HRCGC and NMR" A. J. Wilkes, C. Jacobs, G. Walraven and J. M. Talbot—Colgate Palmolive R&D Inc.—4$^{th}$ world Surfactants Congress, Barcelone, 3-7 VI 1996, page 382. The percentages, by weight, of the mono, di and tri esterquats measured on dried samples are normalized on the basis of 100%. The normalization is required due to the presence of 10% to 15%, by weight, of non-quaternized species, such as ester amines and free fatty acids. Accordingly, the normalized weight percentages refer to the pure esterquat component of the raw material. In other words, for the weight % of each of monoesterquat, diesterquat, and triesterquat, the weight % is based on the total amount of monoesterquat, diesterquat, and triesterquat in the composition.

In certain embodiments, the percentage of saturated fatty acids based on the total weight of fatty acids is 45 to 75%. Esterquat compositions using this percentage of saturated fatty acids do not suffer from the processing drawbacks of 100% saturated materials. When used in fabric softening, the compositions provide good consumer perceived fabric softness while retaining good fragrance delivery. In other embodiments, the amount is at least 50, 55, 60, 65 or 70 up to 75%. In other embodiments, the amount is no more than 70, 65, 60, 55, or 50 down to 45%. In other embodiments, the amount is 50 to 70%, 55 to 65%, or 57.5 to 67.5%. In one embodiment, the percentage of the fatty acid chains that are saturated is about 62.5% by weight of the fatty acid. In this embodiment, this can be obtained from a 50:50 ratio of hard: soft fatty acid.

By hard, it is meant that the fatty acid is close to full hydrogenation. In certain embodiments, a fully hydrogenated fatty acid has an iodine value of 10 or less. By soft, it is meant that the fatty acid is no more than partially hydrogenated. In certain embodiments, a no more than partially hydrogenated fatty acid has an iodine value of at least 40. In certain embodiments, a partially hydrogenated fatty acid has an iodine value of 40 to 55. The iodine value can be measured by ASTM D5554-95 (2006). In certain embodiments, a ratio of hard fatty acid to soft fatty acid is 70:30 to 40:60. In other embodiments, the ratio is 60:40 to 40:60 or 55:45 to 45:55. In one embodiment, the ratio is about 50:50. Because in these specific embodiments, each of the hard fatty acid and soft fatty acid cover ranges for different levels of saturation (hydrogenation), the actual percentage of fatty acids that are fully saturated can vary. In certain embodiments, soft tallow contains approximately 47% saturated chains by weight.

The percentage of saturated fatty acids can be achieved by using a mixture of fatty acids to make the esterquat, or the percentage can be achieved by blending esterquats with different amounts of saturated fatty acids.

The fatty acids can be any fatty acid that is used for manufacturing esterquats for fabric softening. Examples of fatty acids include, but are not limited to, coconut oil, palm oil, tallow, rape oil, fish oil, or chemically synthesized fatty acids. In certain embodiments, the fatty acid is tallow.

At higher AI levels, larger amounts of saturated fatty acids deliver more noticeable results than lower AI levels because the absolute amount of saturated fatty acid is greater, which provides a noticeable difference. While there is still a difference in result at lower AI, the result is less noticeable.

In certain embodiments, the delivered AI is 2.8 to 8 grams per load. In other embodiments, the delivered AI is 2.8 to 7, 2.8 to 6, 2.8 to 5, 3 to 8, 3 to 7, 3 to 6, 3 to 5, 4 to 8, 4 to 7, 4 to 6, or 4 to 5 grams per load.

While the esterquat can be provided in solid form, it is usually present in a solvent in liquid form. In solid form, the esterquat can be delivered from a dryer sheet in the laundry. In certain embodiments, the solvent comprises water.

The composition can be provided as a fragrance free composition, or it can contain a fragrance. The amount of fragrance can be any desired amount depending on the preference of the user. In certain embodiments, the amount of free fragrance oil is 0.3 to 1 weight % of the composition. Free fragrance capsule slurry mixtures could go up to 2 weight % of the composition. Typically, capsule loading is around 45 weight % fragrance oil.

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances.

The composition can contain any material that can be added to fabric softeners. Examples of materials include, but are not limited to, surfactants, thickening polymers, colorants, clays, buffers, silicones, fatty alcohols, and fatty esters.

The fabric conditioners may additionally contain a thickener. In one embodiment, the thickening polymer is the FLOSOFT™ DP200 polymer from SNF Floerger that is described in U.S. Pat. No. 6,864,223 to Smith et al., which is sold as FLOSOFT™ DP200, which as a water soluble cross-linked cationic polymer derived from the polymerization of from 5 to 100 mole percent of cationic vinyl addition monomer, from 0 to 95 mole percent of acrylamide, and from 70 to 300 ppm of a difunctional vinyl addition monomer cross-linking agent. A suitable thickener is a water-soluble cross-linked cationic vinyl polymer which is cross-linked using a cross-linking agent of a difunctional vinyl addition monomer at a level of from 70 to 300 ppm, preferably from 75 to 200 ppm, and most preferably of from 80 to 150 ppm. These polymers are further described in U.S. Pat. No. 4,806,345, and other polymers that may be utilized are disclosed in WO 90/12862. Generally, such polymers are prepared as water-in-oil emulsions, wherein the cross-linked polymers are dispersed in mineral oil, which may contain surfactants. During finished product making, in contact with the water phase, the emulsion inverts, allowing the water soluble polymer to swell. The most preferred thickener for use in the present invention is a cross-linked copolymer of a quaternary ammonium acrylate or methacrylate in combination with an acrylamide comonomer. The thickener required in accordance with the present invention provides fabric softening compositions showing long term stability upon storage and allows the presence of relatively high levels of electrolytes without affecting the composition stability. Besides, the fabric softening compositions remain stable when shear is applied thereto. In certain embodiments, the amount of this thickening polymer is at least 0.001 weight %. In other embodiments, the amount is 0.001 to 0.35 weight %.

The fabric conditioner may further include a chelating compound. Suitable chelating compounds are capable of chelating metal ions and are present at a level of at least 0.001%, by weight, of the fabric softening composition, preferably from 0.001% to 0.5%, and more preferably 0.005% to 0.25%, by weight. The chelating compounds which are acidic in nature may be present either in the acidic form or as a complex/salt with a suitable counter cation such as an alkali or alkaline earth metal ion, ammonium or substituted ammonium ion or any mixtures thereof. The chelating compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA). Suitable organo aminophosphonic acid compounds include: ethylenediamine tetrakis(methylenephosphonic acid); 1-hydroxyethane 1,1-diphosphonic acid (HEDP); and aminotri(methylenephosphonic acid). In certain embodiments, the composition can include amino tri methylene phosphonic acid, which is available as Dequest™ 2000 from Monsanto.

In certain embodiments, the composition can include a C13-C15 Fatty Alcohol EO 20:1, which is a nonionic surfactant with 20 an average of 20 ethoxylate groups. In certain embodiments, the amount is 0.05 to 0.5 weight %.

In certain embodiments, the composition can contain a silicone as a defoamer, such as Dow Corning™ 1430 defoamer. In certain embodiments, the amount is 0.05 to 0.8 weight %.

The composition can be used to soften fabrics by treating the fabric with the composition. This can be done during the rinse cycle of a wash using a liquid fabric softener or in a dryer when using a dryer sheet.

SPECIFIC EMBODIMENTS OF THE INVENTION

The invention is further described in the following examples. The examples are merely illustrative and do not in any way limit the scope of the invention as described and claimed.

Example 1

Raw Materials:

Quaternized triethanol amine ester—This material is predominantly diester of triethanolamine quaternized with dimethylsulfate. The fatty acid to amine ratio used to make this product is 1.65:1. Soft and hard tallow products were obtained from Kao and Stepan. Kao supplied 100% hard tallow. Stepan was asked to create a 50:50 hard tallow to soft tallow product. All theses materials are received as 90% active in 10% isopropanol. Kao material is about 35.6% monoester, about 56.2% diester, and about 8.2% triester. The Stepan material is about 36.4% monoester, 54.5% diester and about 9.1% triester Tetranyl™ L191 S 75% soft tallow/25% hard tallow from Kao, Inc. (listed as 0.25 for Factor 1 in the table below)

Tetranyl™ HT/L1 100% hard tallow from Kao, Inc. (listed as 1.0 for Factor 1 in the table below)

50:50 hard tallow/soft tallow prepared by Stepan (listed as 50/50 for Factor 1 in the Table below)

Amino trimethyl phosphonic acid: Dequest™ 2000 is available from MONSANTO.

An 88% lactic acid is available from Sigma.

C13-C15 Fatty Alcohol EO 20:1 non-ionic surfactant—A synthetic fatty alcohol with an ethoxylated chain containing 20 ethoxylates (Tensapol™ AO-20 from Polioles).

Polyacrylate thickening polymer emulsion in mineral oil, FLOSOFT™ DP200, (56% active) is obtained from SNF Floerger.

Dow Corning™ 1430 silicone is available from. Dow Corning.

Azulmoi NR 240 MOD fragrance is available from International Flavors and Fragrances.

A two factorial design table was created by changing % AI from 4 to 8 and Hard tallow ratio from 25% to 100%. In the 50/50 hard/soft tallow material, the 50% hard tallow and 50% soft tallow translates into 62.5% of the fatty acid chains being saturated. For the soft tallow, not all of the fatty acid chains are fully unsaturated, and for the hard tallow, not all of the fatty acid chains are fully saturated.

| Run | Factor 1 | Factor 2 |
|---|---|---|
| | A: Hard tallow fraction | B: AI level |
| 1 | 1 | 8 |
| 2 | 50/50 (0.625) | 6 |
| 3 | 0.25 | 6 |
| 4 | 50/50 (0.625) | 6 |
| 5 | 1 | 4 |
| 6 | 0.25 | 8 |
| 7 | 50/50 (0.625) | 8 |
| 8 | 50/50 (0.625) | 4 |
| 9 | 1 | 6 |
| 10 | 0.25 | 4 |
| 11 | 50/50 (0.625) | 6 |

Factor 1 displays the hard tallow fraction, which is actual fraction of saturated chains in alkyl group. Factor 2 shows active ingredient level for the esterquat.

| Raw Material | Purity (%) | Formula % |
|---|---|---|
| Deionized Water | 100 | q.s. |
| Dequest ™ 2000 Amino trimethyl phosphonic acid | 100 | 0.1 |
| Lactic Acid | 88 | 0.0625 |
| C13-C15 EO 20:1 nonionic surfactant | 100 | 0.3 |
| Esterquat | 90 | 4-8 |
| Flosoft ™ DP200 thickening polymer from SNF Floerger | 56 | 0.15 |
| Azulmio NR 246 Mod fragrance | 100 | 1 |
| Dow Corning ™ 1430 silicone | 100 | 0.5 |

Preparation Method

Weigh required amount of distilled water in a beaker. Add non-ionic surfactant, amino trimethyl phosphoric acid, and lactic acid to water and mix. Heat to 60° C. Stir the solution using an overhead stirrer at 200 RPM for 2 minutes. In a 300 ml beaker, heat esterquat to 65° C. Add esterquat into solution while stirring at 400 RPM. Mix the solution for 10 minutes. Add SNF™ polymer into the solution and stir for 10 minutes. Check the temperature of the mixture. On cooling to room temperature, add fragrance drop wise. After 5 minutes, add silicone polymer and keep stirring for 10 minutes.

Test Protocol

The 11 samples are evaluated using washing protocol as described below. Run washes are divided into 3 sets of five samples. The control product is included in each set of 5 washes. Runs #2 and #4 are duplicate preparation of the same formulation.

Test Runs:

Test 1 Run #2 as control Samples Runs #1, #3, #4, #5

Test 2 Run #4 as control Samples Runs #6, #2, #8, #9

Test 3 Run #2 as control Samples Runs #3, #10, #11, #7

Formula Repeat Runs #2, #4, #11

Test #1 repeated under same wash conditions as Test 2 and 3 and new evaluation range. Test #1 is repeated to check the consistency in data.

Fabric Treatment with Fabric Softener

Prepare a 2.95 kg (6.5 lb.) load containing 12 hand towels (Blair hand towels, 90% cotton 10% polyester, 60 cm by 40 cm, 120 grams per towels) and ballast (larger size T-shirts and dress shirts) per product.

Using a laundry marking pen, label towels with respective product identification code.

Weigh out detergent samples and fabric softener for each wash.

Clean out washing machine(s) by wiping down the inside of the washing machine(s) with alcohol and run washer(s) on a quick hot wash.

| | |
|---|---|
| Washer Type | Top Loading |
| Wash Cycle | Normal |
| Wash Time | 18 minutes |
| Water Level | 60.6-68.11 (16-18 gal.) |
| Wash Temperature | 25° C. (77° F.) |
| Rinse Temperature | Room Temperature |
| Spin Speed | 400 RPM |
| Water Hardness | 150 ppm |
| Laundry Load Size | 4 Kg |
| Drying | overnight |
| Condition/Setting | 23° C./40-50% R.H. |
| Detergent | Ariel ™ detergent from Mexico |
| Dosage | 120 g |
| Softener Composition | 110 g |

Set wash controls for normal cycle with specified wash period.

Start wash cycle. As washer fills, add calcium carbonate until desired water hardness is obtained.

When machine is approximately half full, add detergent to machine.

When full, let agitate for 1 minute.

Add towels first and then ballast into washer.

Wash for specified amount of time

Stop machine prior to deep rinse cycle. Remove towels and ballast load.

Start deep rinse cycle. When wash tub is one third full with rinse water, add calcium carbonate until desired water hardness is obtained.

Add fabric softener and let agitate to ensure uniform dispersion.

Add damp fabric load. Start machine and allow machine to complete the rinse and spin cycles.

Remove wash load.

Hang on drying racks to dry overnight.

Store towels in humidity controlled room overnight so they can equilibrate.

Panel Evaluation—Softness 20 member panel evaluates the hand towels for softness.

Each member of the panel goes into the room one at a time.

Panelist will first feel control towel.

Panelist will then feel first test towel and rate: 0 is equal in softness to control, or +1 to +5 if softer than control, or −1 to −5 if harsher than control. +1 is slightly softer, +3 is moderately softer, and +5 is extremely softer. −1 is slightly harsher, −3 is moderately harsher, and −5 is extremely harsher.

Panelist will again feel control towel prior to moving to second test towel.

Panelist will proceed until all test towels have been evaluated.

After the every 2 members have voted, stop and refold the towels to allow for a fresh surface. After the first 10 members have voted, stop and replace with a new towel for the last 10 members. Continue to stop and refold the towel after every 2 members to allow for a fresh surface.

| Run | Hard Tallow | Active | Softness |
|---|---|---|---|
| 1 | 1.000 | 8 | 0.00 |
| 2 | 0.625 | 6 | 0.05 |
| 3 | 0.250 | 6 | −0.65 |
| 4 | 0.625 | 6 | −0.60 |
| 5 | 1.000 | 4 | −1.35 |
| 6 | 0.250 | 8 | 0.60 |
| 7 | 0.625 | 8 | −0.55 |
| 8 | 0.625 | 4 | −0.40 |
| 9 | 1.000 | 6 | 1.05 |
| 10 | 0.250 | 4 | −1.15 |
| 11 | 0.625 | 6 | −0.25 |

Fragrance Evaluation—Panel Evaluation 20 member panel evaluates the hand towels for fragrance intensity.

Each member of the panel goes into the room one at a time

Panelist are instructed to remove from plastic bin 1 piece each of control towel and test towels (up to 4 test systems). Each piece is ⅛ to ¼ of a full hand towel. For the control, you will need 5 towels cut into ¼ towel or 3 towels cut into ⅛ towel.

Panelist will first smell control towel.

Panelist will then smell first test towel and rate: 0 is equal in intensity to control, or +1 to +5 if more intense than control, or −1 to −5 if less intense than control. +1 is slightly more intense, +3 is moderately more intense, and +5 is extremely more intense. −1 is slightly less intense, −3 is moderately less intense, and −5 is extremely less intense.

Panelist will discard their control and test towels.

Panelist will again smell control towel prior to moving to next test towel until completed.

| Run | Hard Tallow | Active | Fragrance Day 1 | Fragrance Day 7 |
|---|---|---|---|---|
| 1 | 1.000 | 8 | −0.45 | −0.35 |
| 2 | 0.625 | 6 | −0.15 | −0.70 |
| 3 | 0.250 | 6 | −0.90 | −0.82 |
| 4 | 0.625 | 6 | 0.35 | −0.75 |

-continued

| Run | Hard Tallow | Active | Fragrance Day 1 | Fragrance Day 7 |
|---|---|---|---|---|
| 5 | 1.000 | 4 | −1.60 | −1.00 |
| 6 | 0.250 | 8 | −0.10 | −0.70 |
| 7 | 0.625 | 8 | 0.60 | 0.30 |
| 8 | 0.625 | 4 | −1.00 | −1.55 |
| 9 | 1.000 | 6 | −0.30 | −1.10 |
| 10 | 0.250 | 4 | −1.05 | −1.20 |
| 11 | 0.625 | 6 | 0.05 | −0.15 |

Fragrance Evaluation by SPME Technique:

Apart from panel evaluation, the fragrance deposited on fabric is also determined by SPME (Solid Phase Micro extraction). SPME is an adsorption/desorption technique that eliminates the need for solvent. SPME is a syringe-like device with an outer spectrum piercing needle and plunger that houses a fused silica fiber coated with a stationary phase. Fiber acts like a sponge to extract the fragrance in the headspace of a sealed vial above a piece of fabric. Fiber is then exposed to high (250° C.) temperature to desorb the extracted fragrance into a gas chromatograph for quantification.

Approximately 1 gram of fabric is cut from the sample towels on days one and seven of each test. The fabric swatches are placed in 10 ml vials and pressed down into the bottom half of the vial leaving the top half filled only with headspace. This is done four times for each sample resulting in a total of four replicates per sample. Samples are capped immediately to prevent any of the fragrance in the headspace from escaping. The samples are run using gas chromatography/mass spectrometry.

| Run | Hard Tallow | Active | SPME Total Counts | SPME Top Total Counts | SPME Bottom Total Counts |
|---|---|---|---|---|---|
| 1 | 1.000 | 8 | 2.62E+06 | 1.29E+06 | 2.13E+06 |
| 2 | 0.625 | 6 | 2.00E+06 | 8.97E+05 | 1.36E+06 |
| 3 | 0.250 | 6 | 2.29E+06 | 1.07E+06 | 1.44E+06 |
| 4 | 0.625 | 6 | 1.55E+06 | 7.32E+05 | 1.10E+06 |
| 5 | 1.000 | 4 | 2.50E+06 | 1.18E+06 | 2.03E+06 |
| 6 | 0.250 | 8 | 2.72E+06 | 1.06E+06 | 1.66E+06 |
| 7 | 0.625 | 8 | 2.75E+06 | 1.21E+06 | 1.54E+06 |
| 8 | 0.625 | 4 | 1.38E+06 | 5.89E+05 | 7.95E+05 |
| 9 | 1.000 | 6 | 1.95E+06 | 9.15E+05 | 1.04E+06 |
| 10 | 0.250 | 4 | 1.56E+06 | 7.67E+05 | 7.96E+05 |
| 11 | 0.625 | 6 | 1.38E+06 | 7.20E+05 | 6.59E+05 |

SPME Top: Total counts of fragrance components with retention times shorter than Lilial.
SPME Bottom: Total counts of fragrance components with retention times equal or longer than Lilial For the panel test data generated for softening and fragrance delivery, the statistical evaluation was carried out using a quadratic model and following predictive equations were obtained. The predictive equations use only those parameters with greatest statistical significance. Panel test data is analyzed using Compusense Five software (Compusense Inc) with the statistical significance check at a 90% confidence limit. Design test data is analyzed with the aid of Minitab 15 (Minitab Inc) using a 2 parameter mixture design.

$$\text{Softness}=-0.287+0.15(\text{Hard tallow})+0.49(\text{AI})+0.04(\text{Hard tallow})^2$$

$$\text{Fragrance}=-0.125-0.05(\text{Hard tallow})+0.62(\text{AI})-0.61(\text{Hard tallow})^2$$

Hard tallow is the percent hard tallow and the AI is the delivered AI in grams per wash load.

The fit with greatest degree of significance was found, when one data point was treated as a missing point. The advantage and power of the technique was experienced through acquiring meaningful results and only requiring one data point to be dropped. Since, the panel evaluation tests often show variability in the results, the need to only treat one data point missing due to the variability of nature of softening and fragrance data was very encouraging. The design test methodology has allowed rapid analysis and improved confidence in the resulting understanding of softness and active.

Evaluation of Softness

Figure 1B:
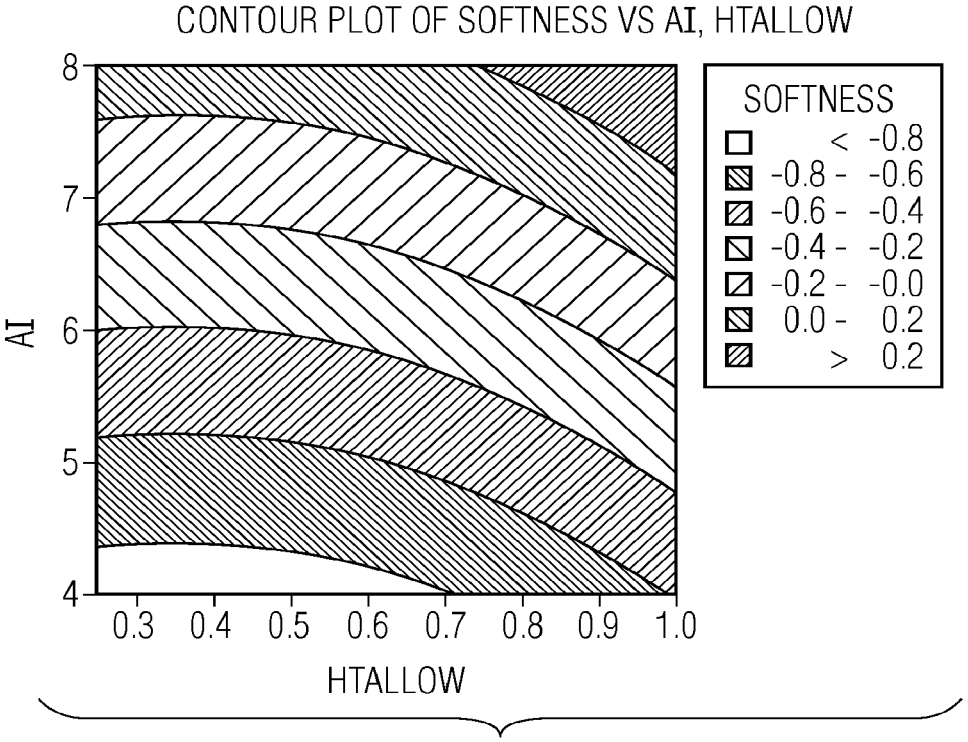
FIG. 1B is a contour plot of softness of different fabric softeners having varying levels of hydrogenated tallow and varying levels of active esterquat levels (AI). AI is on the vertical axis, percentage of hydrogenated tallow is on the horizontal axis, and the panel softness rating is detailed in the legend.

FIG. 1A illustrates the three dimensional; surface plot of % AI (active ingredient) on Y-axis against hard tallow ratio on X-axis in the sample and softness on Z-axis. FIG. 1B illustrates the same data on two dimensional contour plot of % AI (active ingredient) on Y-axis against hard tallow ratio on X-axis in the sample. The color code on the right side of plot shows the degree of softness from >0.2 to <−0.8 range the plot indicates that as you increase the hard tallow from 0.25 to 100% the Softness increases giving maximum softness at 100%. Also, as AI increases the softness increases proportionally. This validates the design test method and test protocol.

Evaluation of Fragrance

Figure 2A:
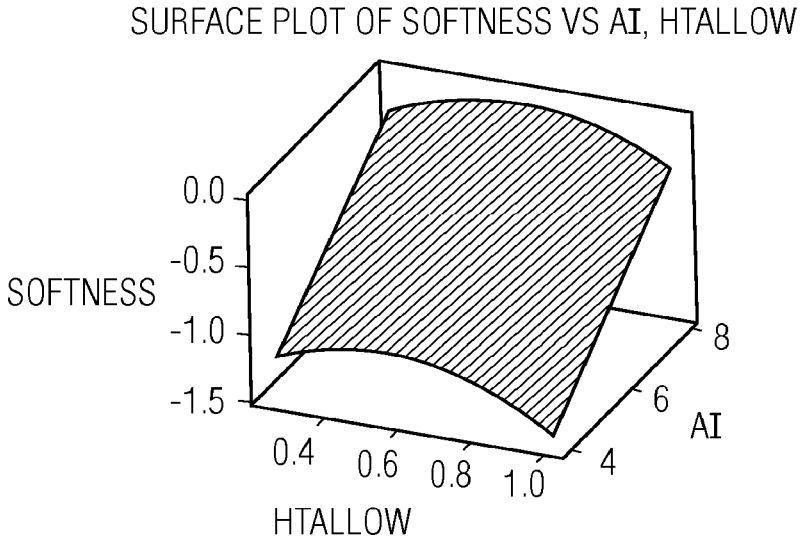
FIG. 2A is a surface plot of panelist rated fragrance intensity of different fabric softeners on day 1 having varying levels of hydrogenated tallow and varying levels of active esterquat levels (AI). Panel fragrance intensity is measured on the vertical axis, percentage of hydrogenated tallow is on the horizontal axis, and AI level is on the depth axis.
Figure 2B:
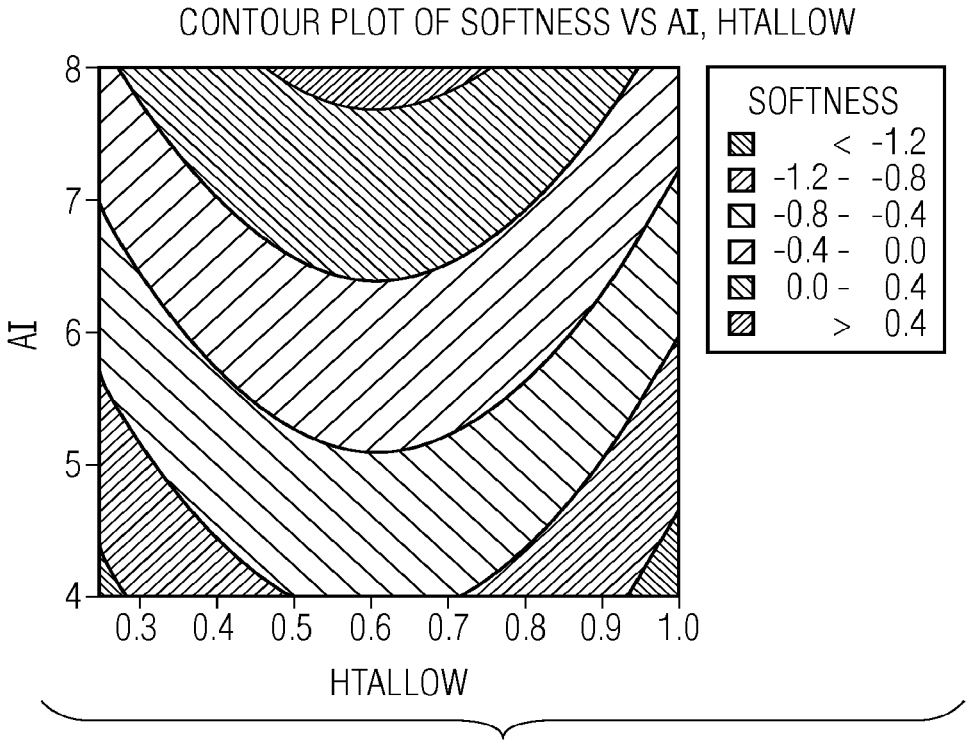
FIG. 2B is a contour plot of panelist rated fragrance intensity of different fabric softeners on day 1 having varying levels of hydrogenated tallow and varying levels of active esterquat levels (AI). AI is on the vertical axis, percentage of hydrogenated tallow is on the horizontal axis, and the panel fragrance rating is detailed in the legend.
Figure 2C:
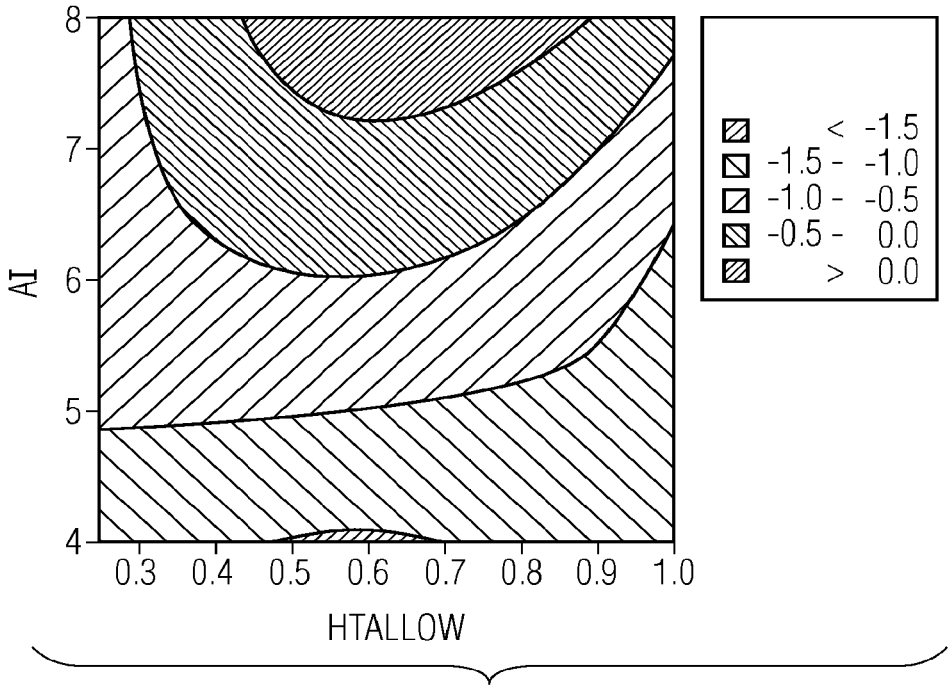
FIG. 2C is a contour plot of panelist rated fragrance intensity of different fabric softeners on day 7 having varying levels of hydrogenated tallow and varying levels of active esterquat levels (AI). AI is on the vertical axis, percentage of hydrogenated tallow is on the horizontal axis, and the panel fragrance rating is detailed in the legend.

FIGS. 2A and 2B show that as % AI increases, the fragrance intensity increases. However the plot of hard tallow vs. fragrance indicates that the increase in fragrance intensity is maximized at around 60% hard tallow level and further increase in saturation do not show any further positive benefit on fragrance delivery. Fragrance delivery at 100% hard tallow drops back to equal or less than the 75% soft tallow/25% hard tallow system. It is theorize that the effect of 100% hard tallow possibly results from less effective incorporation of fragrance into the esterquat structure with low shear mixing. FIG. 2C shows that after 7 days, the inventive system was found by panelists to be statistically more intense.

Fragrance Evaluation through SPME

Figure 3A:
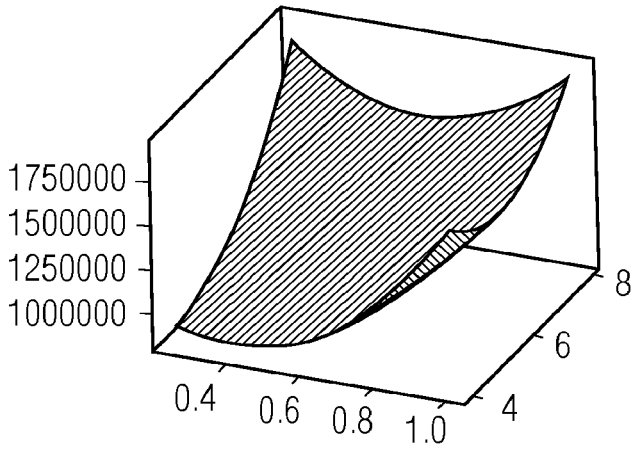
FIG. 3A is a surface plot of bottom fragrance note intensity of different fabric softeners having varying levels of hydrogenated tallow and varying levels of active esterquat levels (AI). Fragrance note intensity is measured on the vertical axis, percentage of hydrogenated tallow is on the horizontal axis, and AI level is on the depth axis.
Figure 3B:
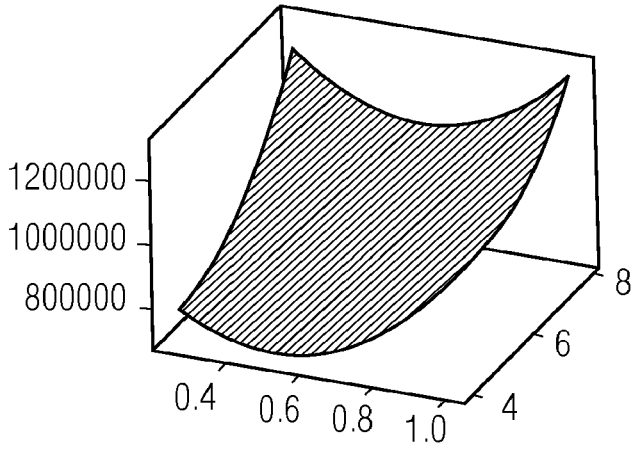
FIG. 3B is a surface plot of top fragrance note intensity of different fabric softeners having varying levels of hydrogenated tallow and varying levels of active esterquat levels (AI). Fragrance note intensity is measured on the vertical axis, percentage of hydrogenated tallow is on the horizontal axis, and AI level is on the depth axis.

The data from SPME is divided into top notes components and bottom notes components. The 3D surface plots in FIGS. 3A and 3B are generated by plotting either top or bottom component vs. % AI and % hard tallow from Day 1.

The plots shows that the Top and Bottom components respond similarly to increasing AI and increasing hard tallow level. At low AI (4%), SPME fragrance delivery strongly increases with increasing hard tallow level. At high AI (8 weight %), fragrance delivery is minimized at lowest and highest hard tallow level. At low hard tallow level (0.25%), fragrance delivery strongly increases with increasing AI level. At high hard tallow level (100%), fragrance delivery increases less strongly with increasing AI.

Increasing hydrophobicity (increasing hard tallow level) of Esterquat was expected to improve its ability to carry hydrophobic fragrance components. This was observed at low AI. At high AI, the response was more complex. It is theorized that this is the result of insufficient processing at the low shear conditions used as hard tallow levels are increased in the formulation.

Example 2

| Raw Material | Purity (%) | Formula % |
|---|---|---|
| Deionized Water | 100 | q.s. |
| Dequest ™ 2000 Amino trimethyl phosphonic acid | 100 | 0.1 |
| Lactic Acid | 88 | 0.0625 |
| Esterquat | 90 | 6.2-13.5 |

-continued

| Raw Material | Purity (%) | Formula % |
|---|---|---|
| Flosoft ™ DP200 thickening polymer from SNF Floerger | 56 | 0.15 |
| Beauty Blue fragrance | 100 | 1 |

Preparation Method

Weigh required amount of distilled water in a beaker. Add amino trimethyl phosphonic acid, and lactic acid to water and mix. Heat to 60° C. Stir the solution using an overhead stirrer at 200 RPM for 2 minutes. In a 300 ml beaker, heat esterquat to 65° C. Add esterquat into solution while stirring at 400 RPM. Mix the solution for 10 minutes. Add SNF™ 200 polymer into the solution and stir for 10 minutes. Check the temperature of the mixture. On cooling to room temperature, add fragrance drop wise. Continue stirring for 10 minutes.

Test Protocol

Fabric Treatment with Fabric Softener

Prepare a 2.95 kg (6.51b.) load containing 12 hand towels. Blair hand towels, 90% cotton 10% polyester, 60 cm by 40 cm, 120 grams per towels and ballast (larger size T-shirts and dress shirts) per product.

Using a laundry marking pen, label towels with respective product identification code.

Weigh out detergent samples and fabric softener for each wash.

Clean out washing machine(s) by wiping down the inside of the washing machine(s) with alcohol and run washer(s) on a quick hot wash.

| | |
|---|---|
| Washer Type | Top Loading |
| Wash Cycle | Normal |
| Wash Time | 15 minutes |
| Water Level | 60.6-68.11 (16-18 gal.) |
| Wash Temperature | 25° C. (77° F.) |
| Rinse Temperature | Room Temperature |
| Spin Speed | 400 RPM |
| Water Hardness | 150 ppm |
| Laundry Load Size | 3.5 Kg |
| Drying | overnight |
| Condition/Setting | 23° C./40-50% R.H. |
| Detergent | US Liquid Tide |
| Dosage | 90 g |
| Softener Composition | 79 g Regular (25 g Ultra) |

Set wash controls for normal cycle with specified wash period.

Start wash cycle. As washer fills, add calcium carbonate until desired water hardness is obtained.

When machine is approximately half full, add detergent to machine.

When full, let agitate for 1 minute.

Add towels first and then ballast into washer.

Wash for specified amount of time

Stop machine prior to deep rinse cycle. Remove towels and ballast load.

Start deep rinse cycle. When wash tub is one third full with rinse water, add calcium carbonate until desired water hardness is obtained.

Add fabric softener and let agitate to ensure uniform dispersion.

Add damp fabric load. Start machine and allow machine to complete the rinse and spin cycles.

Remove wash load.

Hang on drying racks to dry overnight.

Store towels in humidity controlled room overnight so they can equilibrate.

Panel Evaluation—Softness 20 member panel evaluates the hand towels for softness.

Each member of the panel goes into the room one at a time.

Panelist will first feel control towel.

Panelist will then feel first test towel and rate: 0 is equal in softness to control, or +1 to +5 if softer than control, or −1 to −5 if harsher than control. +1 is slightly softer, +3 is moderately softer, and +5 is extremely softer. −1 is slightly harsher, −3 is moderately harsher, and −5 is extremely harsher.

Panelist will again feel control towel prior to moving to second test towel.

Panelist will proceed until all test towels have been evaluated.

After the every 2 members have voted, stop and refold the towels to allow for a fresh surface. After the first 10 members have voted, stop and replace with a new towel for the last 10 members. Continue to stop and refold the towel after every 2 members to allow for a fresh surface.

In the examples below, there are two controls made with Stepantex™ VT-90 esterquat (25% hard/75% soft tallow). The first control is the one that is used as a comparison between all other samples used. The second one is used to correlate the testing with the original control. Panelists do not typically rate all samples at the same time. Samples may be evaluated at different times. To determine the validity of evaluations that are conducted at different times, the second control is used to see if the ratings are similar during the different test times. When the second control is about ±1, the results correlate. In the tables below, the ratings listed for VT90 are for how the second control compares to the first control.

Formulations are prepared as described above. Esterquat is provided as 90% active (solids level). A control formulation with Stepantex™ VT-90 esterquat (25% hard/75% soft tallow) is prepared at 7.8% AI for Regular formulation and 13.5% for Ultra formulation. For 50/50 hard/soft tallow products, they are prepared at 6.2%, 6.6%, 7.0% AI for Regular formulations and at 10.8%, 11.5% and 12.2% for Ultra formulations. Test protocol described above is used to prepare towels. All towels were dried and left to equilibrate over night before softening or fragrance evaluation. Regular formulations are prepared with Beauty Blue free oil fragrance supplied by Firmenich. Ultra formulations are prepared with Zmart Caps fragrance supplied by International Flavors and Fragrances.

Regular Formulation

| | AI % | % Reduction | Dose | Del. AI (g) | Softness | Frag Day1 | Frag Day7 |
|---|---|---|---|---|---|---|---|
| VT90 | 7.8 | — | 79 g | 6.16 | −0.05 a | −0.25 a | −0.4 b |
| 50/50 | 7.0 | −10% | 79 g | 5.53 | −0.15 a | 0.4 a | 0.75 a |
| 50/50 | 6.6 | −15% | 79 g | 5.21 | −0.2 a | −0.1 a | 0 ab |
| 50/50 | 6.2 | −20% | 79 g | 4.9 | 0.5 a | 0.05 a | 0.35 ab |

At all levels evaluated, the 50/50 product delivered statistically equal softening to the 7.8% Stepantex™ VT-90 formulation. Matching letters indicate statistically equal response at a 90% confidence level. The fragrance delivery intensity was also parity for all systems on day 1. After 7 days (towels aged in enclosed plastic file drawers), the 7.0% 50/50 product system was found statistically more intense by panelists. The 50/50 product at 15% and 20% reduced active was statistically equal to the 7.8% Stepantex™ VT-90 control.

Ultra Formulation

| | AI % | % Reduction | Dose | Del. AI (g) | Softness | Day 1 Unrubbed | Day 1 Rubbed | Day 7 Unrubbed | Day 7 Rubbed |
|---|---|---|---|---|---|---|---|---|---|
| VT90 | 13.5 | — | 25 g | 3.38 | −0.05 a | 0.2 ab | 0.45 a | 0.84 a | 1.15 ab |
| 50/50 | 12.2 | −10% | 25 g | 3.05 | 0.2 a | −0.16 b | 0.25 a | 0.45 ab | 0.8 ab |
| 50/50 | 11.5 | −15% | 25 g | 2.88 | −0.3 ab | 0.74 a | 0.8 a | 1.2 a | 1.55 a |
| 50/50 | 10.8 | −20% | 25 g | 2.7 | −1.0 b | −0.05 ab | 0.35 a | 0 b | 0.55 b |

The Ultra formulations using the 50/50 product at 10% and 15% active reduction delivered statistically equal softening to the Stepantex™ VT-90 control. Only the 10.8% active 50/50 product delivered statistically reduced softening efficacy. The 50/50 product Ultra formulations delivered statistically equal fragrance intensity to the Stepantex™ VT-90 control, before and after rubbing. After rubbing, there was a significant increase in fragrance intensity for all products, averaging about 0.4 intensity units. After towels aged 7 days, the 50/50 product at 10% and 15% reduction showed parity performance to the Stepantex™ VT-90 control, while the 20% AI reduction showed statistically lower fragrance intensity than the Stepantex™ VT-90 control.

Difference in Softening Response—Regular vs. Ultra

Increasing the level of hard tallow used in preparation of the esterquat (Soft/Hard 75/25 to 50/50) increases the level of saturated alkyl chains in the finished product. Saturated alkyl chains deliver greater softening efficacy than unsaturated alkyl chains. At higher active delivery levels, such as are found in Regular fabric softener formulations, the potential contribution of the increased level of saturated alkyl chains found in the 50/50 product to increase softening is expected to be significant. As the level of active delivered to the rinse decreases, as by Ultra formulations, the potential contribution to increased softening of added saturated chains becomes less significant. Thus at some point (about 20% reduction), the increased level of saturated chains no longer compensates for the reduction in active level in the Ultra formula. This explains that greater active level reduction, while maintaining parity softening and fragrance delivery, can be achieved when a 50/50 product is used in a Regular formula (−20%) as compared to an Ultra formula (−15%).

Increment in saturation level has positive effects on fabric softness. Above 60% saturation, however, the benefit decreases as fragrance delivery does not increase, and the "consumer perceived softness" does not increase.

The strong positive contribution of active level increment on softness perception was observed over the product active range of 4% to 8%. Increment in hard tallow level (increment in saturated fatty chains) increases softening but to a lower degree.

Fragrance delivery increases over the whole range up to 100% hard tallow. Panel perception maximizes at 60% saturated (50:50 soft: hard).

What is claimed is:

1. A composition comprising an esterquat that is a quaternized reaction product of triethanolamine and a fatty acid comprising tallow having a molar ratio of fatty acid to triethanolamine of about 1.65, wherein 57.5 to 67.5% by weight of the fatty acids are saturated, wherein monoesterquat is present in an amount of 20 to 40 weight %, diesterquat is present in an amount of 50 to 65 weight %, and triesterquat is present in an amount not greater than 25 weight %, wherein the esterquat is present in an amount such that when the composition is used as a fabric softener, the esterquat is delivered at 2.8 to 8 grams per load, a load being 3.5 kilograms of fabric.

2. The composition of claim 1 further comprising a solvent.

3. The composition of claim 2, wherein the solvent comprises water.

4. The composition of claim 1, wherein 60 to 67.5% by weight of the fatty acids are saturated.

5. The composition of claim 1, wherein about 62.5% by weight of the fatty acids are saturated.

6. A method of softening a fabric and increasing fragrance delivery comprising treating the fabric with a composition of any preceding claim.

* * * * *